US007211012B2

(12) United States Patent
Laliberty et al.

(10) Patent No.: US 7,211,012 B2
(45) Date of Patent: May 1, 2007

(54) MULTI-LAYER SOFTBALL

(75) Inventors: Ronald P. Laliberty, Springfield, MA (US); Matthew K. Lacroix, Jaffrey, NH (US); John F. Furlong, Sellersville, PA (US)

(73) Assignee: Russell Corporation, Atlanta, GA (US)

( * ) Notice: Subject to any disclaimer, the term of this patent is extended or adjusted under 35 U.S.C. 154(b) by 0 days.

(21) Appl. No.: 10/634,344

(22) Filed: Aug. 5, 2003

(65) Prior Publication Data

US 2004/0102265 A1 May 27, 2004

Related U.S. Application Data

(60) Provisional application No. 60/401,140, filed on Aug. 5, 2002.

(51) Int. Cl.
*A63B 37/06* (2006.01)

(52) U.S. Cl. ..... 473/601

(58) Field of Classification Search ..... 473/600–602
See application file for complete search history.

(56) References Cited

U.S. PATENT DOCUMENTS

| | | | | |
|---|---|---|---|---|
| 4,272,079 | A | 6/1981 | Nakade | |
| 4,364,565 | A | 12/1982 | Tomar | |
| 4,431,193 | A | 2/1984 | Nesbitt | |
| 4,529,200 | A | 7/1985 | Miller | |
| 4,568,083 | A | 2/1986 | Miller | |
| 4,610,071 | A | 9/1986 | Miller | |
| 4,653,752 | A | 3/1987 | Miller | |
| 4,772,019 | A * | 9/1988 | Morgan | 473/601 |
| 4,840,378 | A | 6/1989 | Molitor | |
| 4,861,028 | A | 8/1989 | Williams | |
| 5,123,659 | A | 6/1992 | Williams | |
| 5,647,590 | A | 7/1997 | Walker | |
| 5,704,858 | A * | 1/1998 | Yang | 473/602 |
| 5,951,420 | A * | 9/1999 | Talarico et al. | 473/601 |
| 6,025,442 | A | 2/2000 | Harris | |

* cited by examiner

*Primary Examiner*—Steven Wong

(57) ABSTRACT

The present invention relates to softballs that have very low compression, but maintain the traditional COR values of standard urethane core softballs. The present invention comprises a softball having a center core and at least one core or mantle layer to produce a softball having the performance of a traditional ball.

13 Claims, 3 Drawing Sheets

MULTI-LAYER SOFTBALL

CROSS REFERENCE TO RELATED APPLICATIONS

This application claims the benefit of U.S. Provisional Application Ser. No. 60/401,140, filed on Aug. 5, 2002.

BACKGROUND OF THE INVENTION

The present invention relates to game balls used in diamond sports. More particularly, the present invention is concerned with game balls, such as softballs, having a dual core construction that is suitable for play under competitive play conditions.

Specifications for softballs used in competitive and tournament play have generally been issued by two governing organizations, the United States Specialty Sports Association (USSSA) and the American Softball Association (ASA). Softballs range in size from 10 to 16 inches in circumference, with 12-inch softballs being the most widely used. The specifications for a 12-inch softball include the following requirements: Coefficient of Restitution (COR) of 0.40 to 0.50; circumference of 11⅞ to 12⅛ inches; compression limits of 375 or 525 pounds, depending on the organization; and weight of 6¼ to 7 ounces (175 to 200 grams).

The COR is extremely important because the COR generally determines the speed of the ball off the bat. More specifically, a ball's COR is the ratio of the relative velocity of the ball after and before direct impact with a fixed surface. As discussed in greater detail below, COR is measured by propelling the ball against a hard surface at 88 feet-per-second (fps) and measuring the rebound speed of the ball. COR is expressed in terms of the ratio of the rebound speed to the initial ball speed of 88 fps. Consequently, the COR can vary from zero to one, with one being equivalent to a fully elastic collision and zero being equivalent to an inelastic collision.

There are other qualities of softballs that are not included in the official specifications or physical properties that are important to players. Examples of these qualities include: the sound of the ball when batted; the "feel off the bat" or, the feel that the batter experiences at the moment of impact of the bat with the ball; flight consistency; durability; the grip and feel of the ball in both bare hands and in a glove; and the ability of the product to maintain those characteristics over an extended period of time.

The various associations that govern softball are continuously investigating the merits of lower compression softballs and how they could benefit the game of softball. Urethane and cork centered softballs have to comply with softball association compression limits that are currently set at either 525 lbs. or 375 lbs., depending on the league and level of play. A softball's compression is obtained by measuring the amount of force required to compress the ball 0.25 inches as prescribed by ASTM methodology (ASTM method F 1888-98). That is, compression determines the pounds of pressure per square inch required to compress a softball 0.25 inches. Compression can be measured using universal test machines that compress the ball between two flat steel platens and record the force with a load cell, such as Instron™, MTS™ or other types machines. Using typical urethane and cork softball constructions, softball manufacturers continually adjust ball constructions to meet the softball associations' compression requirements while continuing to satisfy the ball performance demands required by the players. What is needed in the art is a softball where the performance characteristics can be altered as desired such that the softball has a very low compression while maintaining the standards for COR, durability and performance.

An innovative, multi-layer softball design has been developed that can satisfy the need for lower compressions, while maintaining the performance of a traditional softball. The COR and durability of the new multi-layer product are comparable to a traditional softball at much lower compressions. This innovative new ball also minimizes bat denting and reduces the amount of sting associated with hits that miss the sweet spot of the bat.

SUMMARY OF THE INVENTION

The present invention relates to softballs that have very low compression, but maintain the traditional coefficient of restitution (COR) values of standard urethane core softballs. It has been determined that the use of multiple core layers can be used to produce a softball having the performance of a traditional ball.

The present invention also relates to softballs having multiple core layers. Specifically, the invention relates to a softball having a core, at least one outer core or mantle layer, and a cover. More specifically, the compression of the softball is very low, but the COR and durability are comparable to standard softballs currently produced.

Other objects of the invention will become apparent from the specification, drawings and claims.

BRIEF DESCRIPTION OF THE DRAWINGS

The following is a brief description of the drawings, which are presented for the purposes of illustrating the invention and not for the purposes of limiting the same.

DESCRIPTION OF THE PREFERRED EMBODIMENTS

Figure 1:
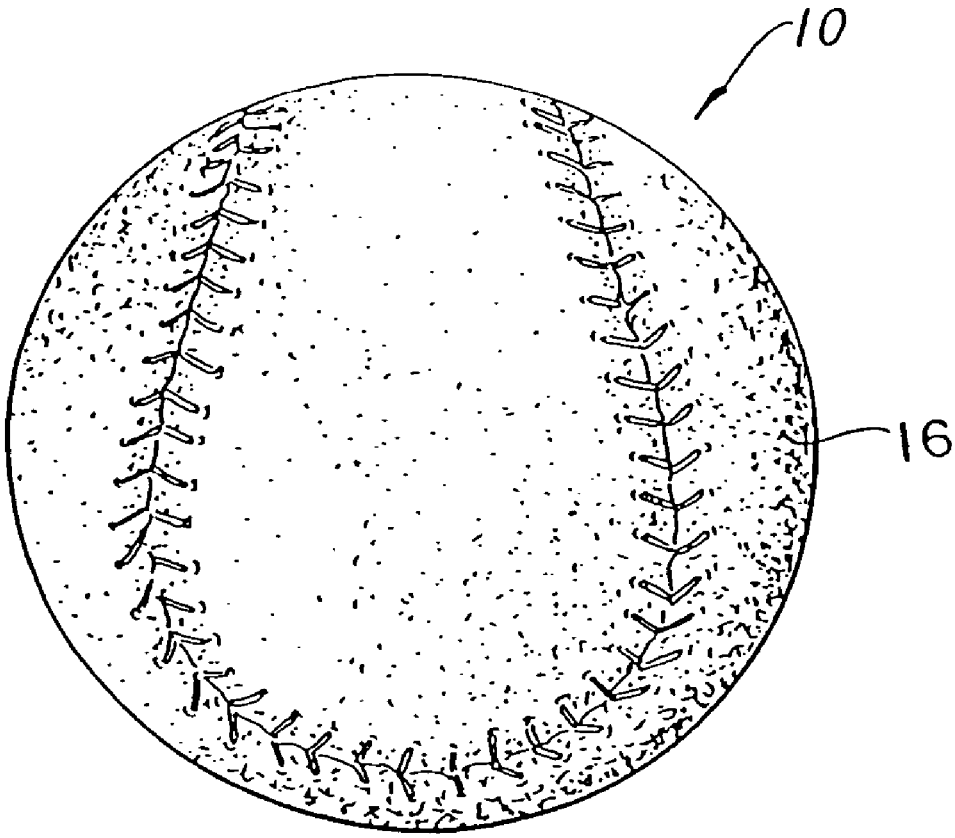
FIG. 1 shows a perspective view of a softball having an outer cover layer.
Figure 2:
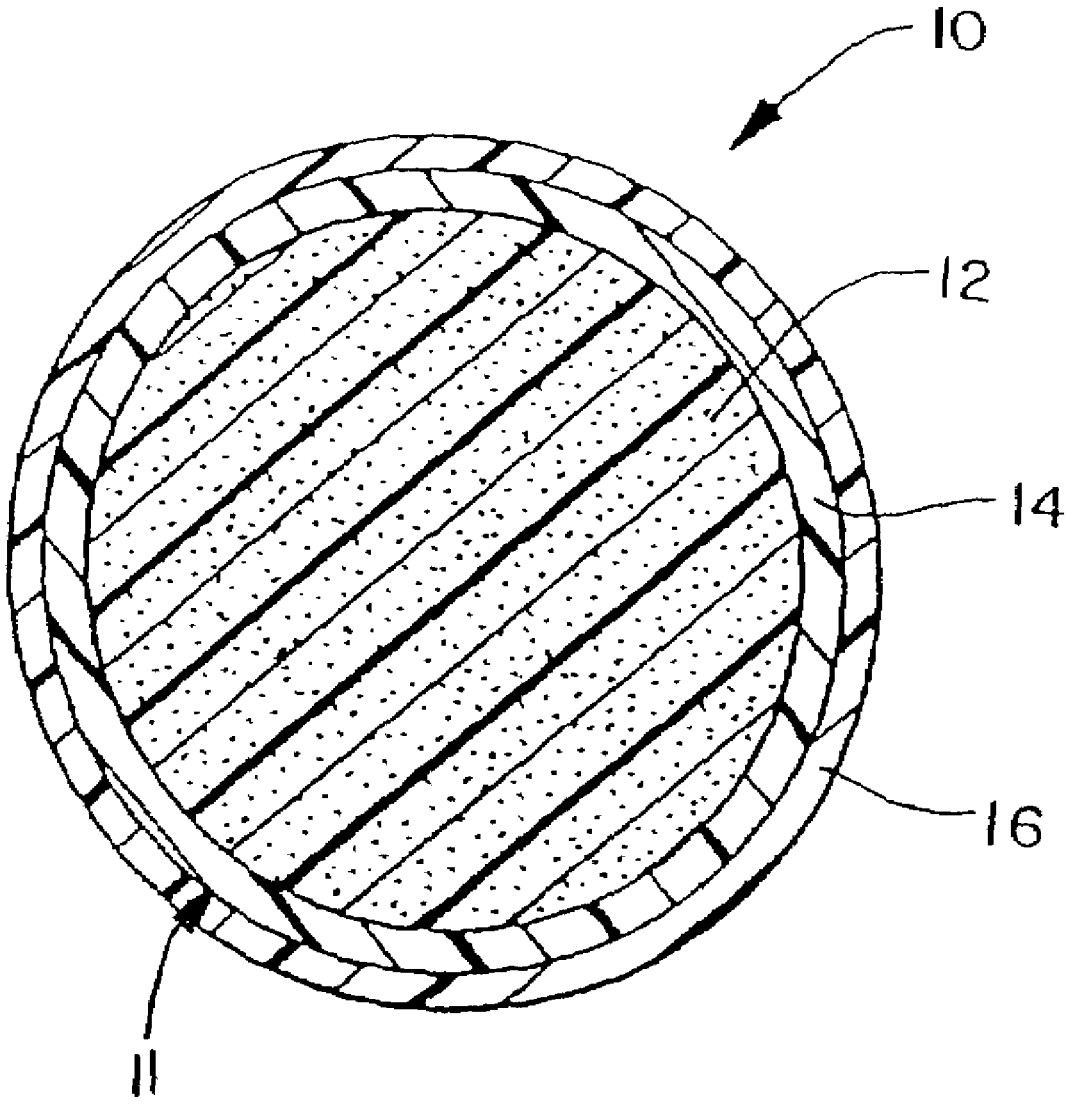
FIG. 2 shows a cross section of a softball with a core, an outer core or mantle layer and an outer cover layer.
Figure 3:
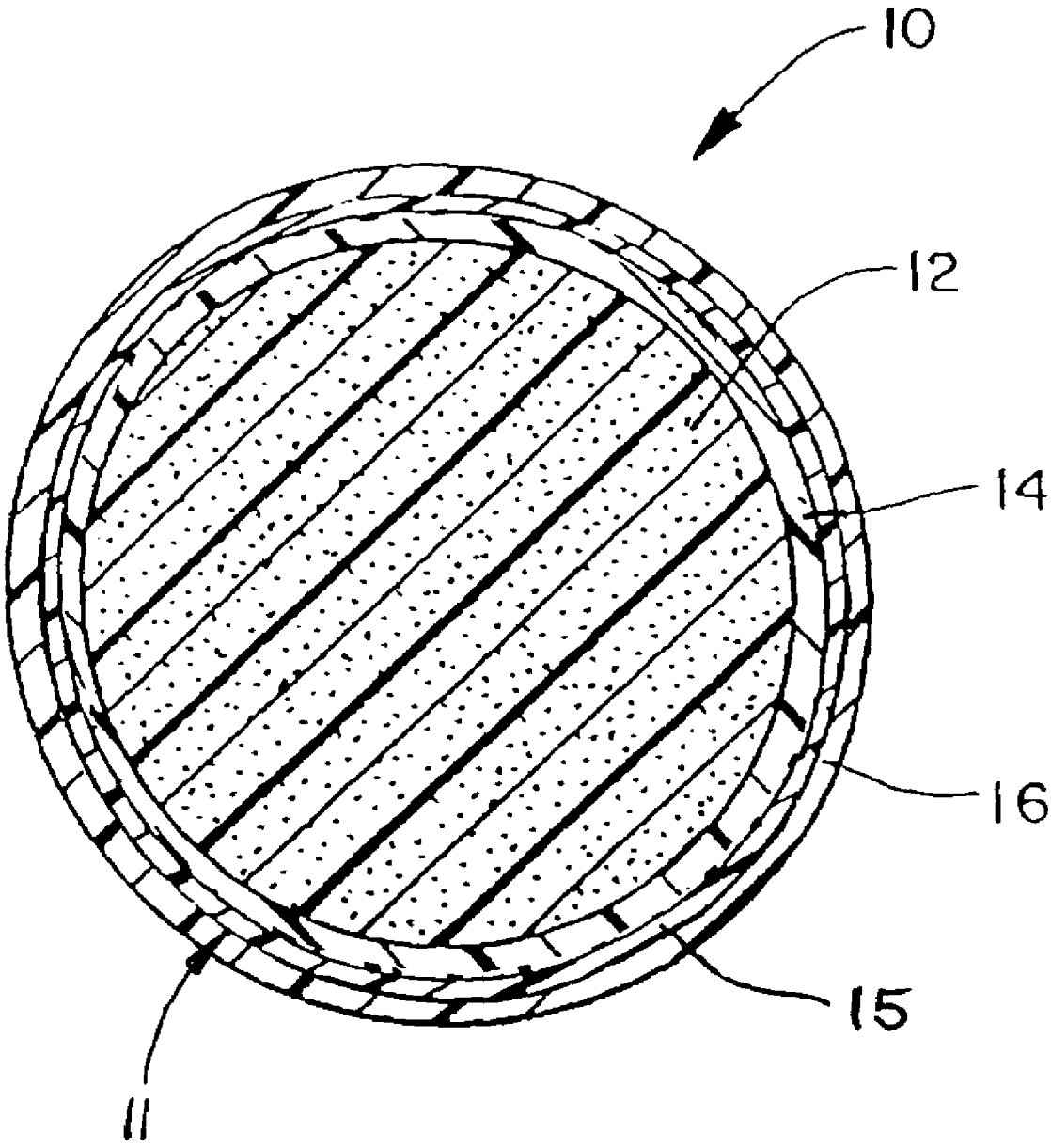
FIG. 3 is shows a cross section of another embodiment of the softball with a core, two outer core or mantle layers and an outer cover layer.

Referring to FIGS. 1 to 3 of the drawings, a perspective view of a softball 10 having an outer cover layer 16 is shown. The cover layer 16 may have traditional stitching, or it may have "stitches" that are molded into the cover to appear like actual stitches. A cross section of a softball 10 is illustrated in FIGS. 2 and 3 incorporating the lower compression core of the invention. The game ball 10 that is illustrated in FIG. 2 is a softball construction comprising a composite core 11 and a cover layer 16 surrounding the composite core 11. The composite core 11 includes a central core 12 and a first outer core or mantle layer 14 around the central core 12. The game ball 10 that is illustrated in FIG. 3 is a softball construction comprising a composite core 11 having a first and second mantle layer 14, 15. That is, the composite core 11 includes a central core 12, a first core or mantle layer 14 around the central core 12, a second outer core or mantle layer 15 surrounding the first mantle layer 14. A cover layer 16 thereby encircles the second outer core or mantle layer 15. The terms "core layer" and "mantle layer" are used interchangeably throughout, and they refer to a layer disposed about a central, preferably spherical, core 12.

Any desired cover material known in the art can be used on the ball 10. The cover layer 16 is preferably, but not necessarily, stitched to the composite core 11, especially if the ball 10 is to be used in competitive play. The cover 16 may also be molded on the ball 10 using processes known in the art, such as a plastisol fusion process, particularly if the softball 10 is not for competitive play in leagues requiring stitched covers. Examples of materials suitable for use as the cover layer 16 include, but are not limited to: polyurethanes, including thermoplastic polyurethanes; polyvinylchloride (PVC); natural leather; synthetic leather; and composite leather. Materials suitable for use as the central core 12 include, but are not limited to: cork; kapok; urethanes; thermoplastics; and other rubber materials generally known in the art. Examples of materials suitable for the first and second mantle layers 14, 15 include, but are not limited to: urethanes; thermosets; thermoplastics; and the like. Preferably, the central core 12 and the first and second mantle layer(s) 14, 15 comprise urethane.

Looking to FIG. 2, the multi-layer softball 10 of the invention comprises a central core 12, at least one mantle layer 14, and a cover 16 covering the mantle layer 14. The goal is to achieve a certain coefficient of restitution (COR) and durability of the ball 10, and preferably, to have a low compression. The inventors have found that a softball 10 having multiple layers constructed of certain materials, such as those described above, exhibits low compression while maintaining desired COR and durability levels necessary for softballs 10 used in competitive play. It was determined that using a softer outer core or mantle layer(s), such as a softer urethane or other foam material, would reduce the overall compression, thus reducing the bat denting, compression and the like, while maintaining durability and performance.

A typical softball with a polyurethane core has a construction comprising a urethane core and a single cover layer. Other softball designs may have cork centers that are traditionally wrapped in cloth or yarn windings, but this invention is not concerned with that type of softball. The softballs 10 of the invention have an additional mantle layer (or layers) 14, 15 between the central core 12 and the cover 16, as previously described. This mantle layers 14, 15 are added to control or to change the performance characteristics of the ball 10 and to make it feel softer yet have many of the desirable characteristics of a traditional softball.

The unique multi-layer construction of the present invention preferably features the dual core or composite core design and a traditional stitched softball cover 16, such as a leather, synthetic leather or composite cover. The central core 12 is preferably comprised of a semi-rigid to rigid urethane composition with a density of approximately 10 to 30 lbs/ft$^3$, more preferably 15 to 25 lbs/ft$^3$, and even more preferably 18 to 22 lbs/ft$^3$. The size, compression, and resiliency of the central core 12 can vary with the material selection and mix ratio of the urethane system used. The size of the central core 12 and outer core layer(s) may vary as desired, but the completed composite core 11 must be equal to the size of a standard 12-inch softball core resulting in a stitched softball that meets the size requirements of various softball associations. In other organizations, an 11-inch softball may be used. For purposes of this invention, the 12-inch softball is the primary focus, although the concept applies to other size softballs as well by appropriately modifying the sizes of the central core 12 and the thickness of the mantle layer 14.

The standard diameter of a 12-inch softball core can range from about 3.650 to about 3.700 inches, preferably about 3.680 inches. The central cores 12 for the multi-layer softball 10 of the present invention must be reduced in size to accommodate the outer mantle layer or layers 14, 15. The thickness of the outer mantle layer or layers 14, 15 is preferably from about 0.0500 to about 0.500 inches, more preferably 0.100 to 0.250 inches, even more preferably about 0.125 to about 0.135 inches, and most preferably about 0.125 inches or ⅛ inches. In order to obtain a mantle layer or layers 14, 15 with a preferred thickness of 0.125 inches, the central core 12 is produced to range in size from about 3.41 to 3.43 inches, preferably about 3.42 inches (finished size). Other sizes can also be produced as desired, depending on the desired physical properties and thickness of the mantle layer 14, 15. To produce a central core 12 in the range of about 3.41 to 3.43 inches, a mold (not illustrated) having a size of approximately 88.5 mm is preferably used. Generally, urethane systems have some shrinkage after molding, which needs to be taken into account when determining the proper mold size. For example, while an 88.5 mm mold produces an central core 12 approximately 3.484 inches in diameter, the central core 12 will shrink about 0.040 inches to produce a final central core 12 of approximately 3.444 inches in diameter.

After the central core 12 is molded, it may be further processed, for example, by sanding. The central core 12 is sanded down for two reasons. First, it gives the manufacturer the opportunity to achieve a target finished size (i.e., 3.42 inches) with a limited number of molds. Second, the surface of central core 12 generally contains mold release agent, which is necessary to remove central core 12 from the mold. The sanding of central core 12 removes the mold release layer and significantly improves the adhesion between the central core 12 and the adjoining first outer mantle layer 14. Sanding also improves adhesion between the completed composite core 11 and the cover 16.

The selection of the urethane system and the proper mix ratio is important to achieve the desired central core compression and COR. In addition to varying the COR of the central core 12, the compression can also be affected by altering the mix ratio of the urethane system. The compression of the central core 12 is preferably about 300 to 600 lbs., more preferably about 325 and 575 lbs., and even more preferably about 325 to 475 lbs.

Any suitable urethane polymer system known in the art may be used to create both the central core 12 and mantle layers 14, 15. Generally, the urethane system is a mixture of a polyol and an isocyanate. Examples of suitable polyols include, but are not limited to, polyester polyols, polyether polyols, and combinations thereof. Examples of suitable isocyanates include, but are not limited to, diphenylmethane diisocyanate (MDI); toluene diisocyanate (TDI); and combinations thereof, although other suitable diisocyanates may be used. Preferably, the polyol and isocyanate are mixed at a ratio of 40 to 100 parts by weight polyol to 40 to 100 parts by weight isocyanate. Examples of commercial urethane materials suitable for use in the invention include Elastoflex® urethane systems, available from BASF, as well as urethane systems available from Bayer Chemical, Uniroyal, and the like. Preferably, the mix ratio of polyol to isocyanate is from about 100/80 to about 100/40, more preferably from about 100/70 to about 100/45, depending on the urethane system used and the compression desired. These mix ratios will produce an central core 12 having a compression of about 350 to about 550 lbs., and the central core 12 will also be able to stand 185 blows on the Spalding "Pound Test" (details discussed below). It is important to note that overindexing the system (or changing the mix ratio of polyol to isocyanate too much from the recommended ratio) will increase the compression of central core 12 considerably, but it can compromise the durability of central core 12.

When the desired mix ratio is selected, the various components of the central core 12 are mixed using currently commercially available urethane mixing and metering equipment. A predetermined amount of the mixed urethane, preferably from about 100 to 130 grams, more preferably from about 115 to 120 grams, is then added to the mold via an "open pour" method. The mold is closed and the urethane is allowed to foam. The urethane will react and expand and take the shape of the mold. The mold then passes along a conveyor system and is opened after approximately eight minutes. The amount of time the urethane mixture remains in the mold will have an effect on the shrinkage of central core 12. Catalysts in the urethane system stop or shut off the reaction after a certain amount of time. This allows the urethane system to cross link and harden. As mentioned above, after molding, central core 12 is removed and, if desired, sanded to the appropriate size.

The second mantle layer 15 of the composite core 11 is preferably an elastomeric system, more preferably an elastomeric urethane system, that significantly reduces the compression of the completed composite core 11, but does not compromise overall performance of the ball 10. The density of the second mantle layer material 15 is preferably 20 to 40 lbs/ft$^3$, more preferably 25 to 35 lbs/ft$^3$. A softball 10 made with the multi-layer design of the invention will have a compression under 400 lbs. preferably under 375 lbs., more preferably under 325 lbs. if the thickness of the outer layer is about 0.125 inches or greater. The thicker the second mantle layer 15, the lower the compression will be.

The second outer mantle layer 15 may be formed from any suitable urethane system. One preferred urethane for use in the outer layer is BASF's Elastocast® elastomeric system. The urethane system is again mixed using commercially available urethane mix and metering equipment and dispensed into a mold (not illustrated) where the central core 12 has been placed. A shot weight of from about 45 to 50 grams is added to a mold. To produce a composite core 11 of the correct size, a mold of about 94.2 mm is preferably used. Preferably, the mold has been modified with pins to hold the central core 12 in place while the first outer mantle layer 14 is molded about the central core 12. Several stationary pins (not illustrated), preferably three or more, extend into the mold in both the top and bottom hemispheres in order to hold the central core 12 in place and ensure proper distribution of the outer layer about the central core 12. The inventors determined that a two shot process produced a better product because it allowed the outer core layer 14, 15 to overcome the surface tension in the mold and flow properly. Half of the shot is poured into the bottom of the mold. The central core 12 is placed onto the pins in the bottom hemisphere of the mold. The second half of the shot is then poured directly over the central core 12. This wetting of the surface helps the urethane system foam more readily. The mold is then closed and is passed along the conveying system. The urethane system reacts and expands to produce the second component, the second outer core layer 15, of the dual core softball design of the invention. For additional outer core layers beyond the first and second outer core layers 14, 15, the above process is repeated with appropriate mold sizes and weights.

The 94.2 mm mold is used to produce a thickness on the second outer layer 15 of approximately 0.125 inches. The 94.2 mm mold has a diameter of 3.709 inches. As previously discussed, there is some shrinkage of central core 12, approximately 0.040 inches during the cooling process. After molding and shrinkage, the completed composite core 11 is approximately 3.67 inches.

The size and thickness of the core layers 14, 15 are determined via the following procedure. The size of the central core 12 (approximately 3.42 inches) is subtracted from the completed size of the composite core 11 after shrinkage (about 3.67 inches). The difference (0.250 inches) is then divided by two (as there is a layer on either side of the central core 12 in a cross-section) to get the thickness of the first outer core layer 14 (0.125 inches on each side of the central core 12). This method can be used to determine the appropriate central core 12 size for a desired outer core layer thickness. For example, for a composite core 11 with an outer core layer thickness of 0.177 inches, a finished central core size of approximately 3.334 inches would be used. To obtain this core size, an 86.5 mm mold would be necessary, which would produce a central core 12 of 3.366 inches (3.406 inches−0.040 inches for shrinkage). Central core 12 could then be sanded down to achieve the target size of 3.334 inches. The same procedure is used for multiple layers.

In one preferred embodiment, the second mantle or outer core layer 15 is formed over the first outer core layer 14. In one preferred embodiment, the second outer core layer 15 is very thin and harder than the first outer core layer 14. A harder layer makes the ball 10 feel more like a traditional harder ball, while still having a low compression. In another embodiment, two or more softer layers may be molded over the central core 12.

Additional materials, as known in the art, may be added to the central core 12, the first and second outer core layers 14, 15, or both, as desired. Such additional materials include water, catalysts, blowing agents, surfactants, dyes, and the like.

The material that is selected for the cover 16 depends on the weight of the completed composite core 11 and the desired finished properties and uses. The finished ball 10 weight must be between about 175 to 200 grams, preferably about 180 to 190 grams, more preferably about 185 grams. A multi-layer composite core 11 that uses a central core 12 of approximately 115 grams and an outer layer of approximately 50 grams would have to use a lightweight composite "leather" cover 16 to achieve the necessary finished ball weight. A stitched composite "leather" cover 16 would only increase the weight of the ball 10 by approximately 15 grams. In order to use a traditional leather or synthetic leather cover 16 on this ball 10, the weight of the completed composite core 11 would have to be about 150 grams, requiring an central core weight of about 100 grams or a different thickness core layer. The lighter central core 12 is possible, but it may compromise the durability of the product. As an alternative, decreasing the density of the first or second outer mantle layer 14, 15 would decrease the weight of the composite core 11. However, decreases in density often result in drops in COR performance of central core 12.

EXAMPLES

In the following examples, sample multi-layer softballs 10 were made using a 100 gram shot for the central core 12. The samples were made with two different outer core layer thicknesses (0.1375 and 0.177 inches) at two COR levels (approximately 0.44 and 0.47).

Coefficient of Restitution (COR) of the softball was measured by a Jugs® pitching machine (as sold by The Jugs Company) with ballistic screens. In the test, the softball 10 was propelled by two rotating pneumatic tires at a ball speed of 88 ft/sec. against a steel plate positioned eight feet from the point where the softball 10 is pinched and subsequently hurled by the rotating tires. The COR is return or rebound velocity divided by the initial velocity.

Durability of the softball 10 was measured using the Spalding durability "Pound Test". To perform the test, central core 12 is placed in a retainer cup of a softball pound tester. The hammer used for pounding the ball is placed approximately 98¾ inches from the ball. The hammer weights about 7½ pounds, the radius of the hammer is about 13/32 inches, and it travels at a speed of about 20.83 to 20.84 ft/sec. The test consists of up to 185 blows to the ball. If the ball cracks, fewer blows are made. After testing, the balls are placed in a cold room for 2 hours before any post-pound test measurements are taken.

Example 1

A first group of multi-layer softballs 10 was produced. The central core 12 was produced according to the parameters in Table 1. Both 0.440 and 0.470 COR softballs 10 were made for testing. Two different, but similar, urethane systems were used for each size. The central cores 12 of the 0.44 COR products were made with BASF Elastoflex 25066R urethane, while the 0.47 COR products were made with BASF Elastoflex 25063R urethane. Multi-layer variations 1 and 2 were produced with an outer mantle layer 14 having a thickness of about 0.177 inches. Variations 1 and 2 were produced using an 86.5 mm mold for the central core 12 and a 94.7 mm mold for the outer mantle layer 14. Multi-layer variations 3 and 4 were made with an 88.5 mm mold for the central core 12 with a 94.7 mm. mold for the outermantle layer 14, and the outer mantle layer 14 has a thickness of about 0.1375 inches.

Variations 1 and 2 were compared to the core of a Dudley™ WT-12RF80 softball. Variation 1 compared very favorably to the control core. The COR of Variation 1 was higher than the COR of the control core at 60 mph, and very close to the COR of the control core at 40 and 80 mph. However, the compression of Variation 1 was only 171 lbs., which was considerably lower than the 565 lbs. compression of the control. Variation 2 had a thinner outer mantle layer 14 (0.1375 inches) than Variation 1 (0.177 inches). The compression of Variation 2 was 200 lbs. The COR of Variation 2 was slightly lower than the WT-12RF80 control ball, but within legal limits. Variation 2 multi-layer balls 10 had higher COR values than the Dudley™ WS-12RF80 at 40, 60, and 80 mph. Variation 2 was chosen for the player test because it was closer to desired final product specifications, which include a multi-layer softball 10 with an outer mantle layer 14 of approximately 0.125 inches. Additionally, the thinner outer core layer produced a softball having a firmer feel than ball of Variation 1.

The 0.47 COR multi-layer samples (Variations 3 and 4) were tested against the Dudley™ WT-12RF. Both multi-layer softballs 10 had significantly lower compressions than the control (240 lbs. or less for the multi-layers vs. 494 lbs. for the control). Variation 3 had an outer mantle layer 14 with a thickness of about 0.177 inches, and higher COR values than the control at 40, 60, and 80 mph. Variation 4 had COR values that were very similar to the control balls at all three firing velocities. Both of the multi-layer balls 10 produced survived 185 blows for the durability test. The durability of these central cores 12 was not quite as good as earlier samples because of the selected shot weight. These samples used a 100 gram shot weight, instead of a 115 gram that provides better durability.

TABLE 1

| | A | B | C | D |
|---|---|---|---|---|
| Urethane System | Elastoflex ™ 25066R | Elastoflex ™ 25063R | Elastoflex ™ 25066R | Elastoflex ™ 25063R |
| C. O. R. | 0.440 | 0.470 | 0.440 | 0.470 |
| Mix Ratio | 100/71.5–100/72.0 | 100/66.0–100/66.5 | 100/71.5–100/72.0 | 100/66.0–100/66.5 |
| Mold Size | 86.5 mm | 86.5 mm | 88.5 mm | 88.5 mm |
| Sanded Core Weight | 100 Grams | 100 Grams | 100 Grams | 100 Grams |
| Size Range of Sanded Cores | 3.345"–3.365" | 3.345"–3.365" | 3.420–3.440" | 3.420–3.440" |

The outer mantle layer 14 was molded using 94.7 mm molds with the modified pins. The outer mantle layer 14 was molded to have a thickness of about 4.5 mm (approximately 0.177 inches) using the 3.35 inches (nominal) central cores 12 shown in Table 1 (Cores A and C), and about 3.49 mm thick (approximately 0.1375 inches) using the 3.43 inches (nominal) central cores (Cores B and D). All outer mantle layers 14 were molded using the Elastocast™ urethane system. The multi-layer cores 11 were tested for size, weight, compression, COR and durability. Test results are shown in TABLES 2 and 3 below.

TABLE 2

Variation #1
Central core 'A' (.44 COR Central core - 86.5 mm Mold) With BASF Elastocast ™ Outer Layer

| Central core | Mantle Layer | Core No. | Weight (g) | Size Pole (in) | Size Eq. (in) | Comp. Pole (lbf) | Comp. Eq. (lbf) |
|---|---|---|---|---|---|---|---|
| A | Elastocast ™ | 1 | 148.6 | 3.701 | 3.700 | 177.4 | 161.4 |
| A | Elastocast ™ | 2 | 148.0 | 3.683 | 3.697 | 195.5 | 175.3 |
| A | Elastocast ™ | 3 | 146.3 | 3.683 | 3.697 | 177.4 | 156.1 |
| A | Elastocast ™ | 4 | 150.4 | 3.698 | 3.701 | 156.7 | 164 |
| A | Elastocast ™ | 5 | 145.2 | 3.685 | 3.703 | 179.7 | 157.1 |
| A | Elastocast ™ | 6 | 145.9 | 3.682 | 3.703 | 190.0 | 160.4 |
| | | Ave. | 147.4 | 3.689 | 3.700 | 170.9 | |

| Central core | Mantle Layer | Core No. | COR @ 40 mph | COR @ 60 mph | COR @ 80 mph | Durability |
|---|---|---|---|---|---|---|
| A | Elastocast ™ | 1 | 0.489 | 0.444 | 0.408 | 185 blows |
| A | Elastocast ™ | 2 | 0.494 | 0.451 | 0.404 | |
| | | Ave. | 0.492 | 0.448 | 0.406 | |

TABLE 2-continued

Variation # 2
Central core 'C' (.44 COR Central core - 88.5 mm. Mold) With BASF Elastocast ™ Outer Layer

| Central core | Mantle Layer | Core No. | Weight (g) | Size Pole (in) | Size Eq. (in) | Comp. Pole (lbf) | Comp. Eq. (lbf) |
|---|---|---|---|---|---|---|---|
| C | Elastocast ™ | 1 | 143.6 | 3.698 | 3.703 | 213.9 | 209.7 |
| C | Elastocast ™ | 2 | 144.7 | 3.696 | 3.706 | 199.0 | 201.4 |
| C | Elastocast ™ | 3 | 140.0 | 3.670 | 3.701 | 225.9 | 197.4 |
| C | Elastocast ™ | 4* | 144.8 | 3.689 | 3.706 | 212.9 | 205.3 |
| C | Elastocast ™ | 5* | 142.7 | 3.699 | 3.709 | 187.7 | 180.5 |
| C | Elastocast ™ | 6* | 145.5 | 3.699 | 3.708 | 206.5 | 206.6 |
| | | Ave. | 143.6 | 3.692 | 3.706 | 203.9 | |

| Central core | Mantle Layer | Core No. | COR @ 40 mph | COR @ 60 mph | COR @ 80 mph | Durability |
|---|---|---|---|---|---|---|
| C | Elastocast ™ | 1 | 0.485 | 0.432 | 0.397 | Some denting |
| C | Elastocast ™ | 2 | 0.488 | 0.437 | 0.404 | |
| | | Ave. | 0.487 | 0.435 | 0.401 | |

* Denotes Cores that had a Leather Cover Stitched Over them.

0.44 Control

| Item # | Control Core | Ball | Comp. Pole | Comp. Eq. | COR @ 40 mph | COR @ 60 mph | COR @ 80 mph |
|---|---|---|---|---|---|---|---|
| 43–141 | WT 12 RF80 (COR.44) | 1 | 567.5 | 567.8 | 0.492 | 0.439 | 0.405 |
| 43–141 | WT 12 RF80 (COR.44) | 2 | 566.4 | 559.8 | 0.497 | 0.439 | 0.409 |
| | | Ave. | 565.4 | | 0.495 | 0.439 | 0.407 |
| 43–221 | WS 12 RF80 (COR.44) | 1 | 412 | — | 0.475 | 0.433 | 0.397 |
| 43–221 | WS 12 RF80 (COR.44) | 2 | 418 | — | 0.465 | 0.429 | 0.398 |
| | | Ave. | 415.0 | | 0.470 | 0.431 | 0.398 |

TABLE 3

Variation #3
Central core 'B' (.47 COR Central core - 86.5 mm. Mold) With BASF Outer Layer

| Central core | Mantle Layer | Core No. | Weight (g) | Size Pole (in) | Size Eq. (in) | Comp. Pole (lbf) | Comp. Eq. (lbf) |
|---|---|---|---|---|---|---|---|
| B | Elastocast ™ | 1 | 149.6 | 3.678 | 3.698 | 201.2 | 172.8 |
| B | Elastocast ™ | 2 | 149.7 | 3.684 | 3.691 | 183.8 | 180 |
| B | Elastocast ™ | 3 | 150.7 | 3.688 | 3.693 | 186.7 | 173.8 |
| B | Elastocast ™ | 4 | 147.5 | 3.689 | 3.696 | 167.7 | 157.5 |
| B | Elastocast ™ | 5 | 149.8 | 3.701 | 3.704 | 172.7 | 166.1 |
| B | Elastocast ™ | 6 | 147.5 | 3.682 | 3.693 | 173.3 | 156.6 |
| | | Ave. | 149.1 | 3.687 | 3.696 | 174.4 | |

| Central core | Mantle Layer | Core No. | COR @ 40 mph | COR @ 60 mph | COR @ 80 mph | Durability |
|---|---|---|---|---|---|---|
| B | Elastocast ™ | 1 | 0.522 | 0.471 | 0.435 | 185 blows (minor denting) |
| B | Elastocast ™ | 2 | 0.523 | 0.470 | 0.438 | |
| | | Ave. | 0.523 | 0.471 | 0.437 | |

Variation #4
Central core 'D' (.47 COR Central core - 88.5 mm. Mold) With BASF Elastocast ™ Outer Layer

| Central core | Mantle Layer | Core No. | Weight (g) | Size Pole (in) | Size Eq. (in) | Comp. Pole (lbf) | Comp. Eq. (lbf) |
|---|---|---|---|---|---|---|---|
| D | Elastocast ™ | 1 | 147.5 | 3.677 | 3.698 | 262.9 | 239.7 |
| D | Elastocast ™ | 2 | 143.5 | 3.672 | 3.698 | 247.9 | 233.6 |

TABLE 3-continued

| | | | | | | | |
|---|---|---|---|---|---|---|---|
| D | Elastocast ™ | 3 | 147.4 | 3.696 | 3.712 | 234.2 | 229.8 |
| D | Elastocast ™ | 4* | 147.3 | 3.701 | 3.710 | 232.8 | 232 |
| D | Elastocast ™ | 5* | 147.4 | 3.695 | 3.700 | 249.4 | 230.4 |
| D | Elastocast ™ | 6* | 147.1 | 3.699 | 3.711 | 242.9 | 232.4 |
| | | Ave. | 146.7 | 3.690 | 3.705 | 239.0 | |

| Central core | Mantle Layer | Core No. | COR @ 40 mph | COR @ 60 mph | COR @ 80 mph | Durability |
|---|---|---|---|---|---|---|
| D | Elastocast ™ | 1 | 0.517 | 0.465 | 0.429 | 185 blows (minor denting) |
| D | Elastocast ™ | 2 | 0.517 | 0.463 | 0.427 | |
| | | Ave. | 0.517 | 0.464 | 0.428 | |

* Denotes Cores that had a Leather Cover Stitched Over them.

0.47 Control

| Item # | Control Core | Ball | Comp. Pole | Comp. Eq. | COR @ 40 mph | COR @ 60 mph | COR @ 80 mph |
|---|---|---|---|---|---|---|---|
| 43–131 | WT 12RF (COR .47) | 1 | 519.3 | 513.2 | 0.521 | 0.471 | 0.433 |
| 43–131 | WT (COR .47) | 3 | 473.6 | 470.8 | 0.515 | 0.467 | 0.432 |
| 43–131 | WT 12RF (COR .47) | 5 | 501.1 | 488.7 | 0.512 | 0.463 | 0.432 |
| | | | Average | | 0.516 | 0.467 | 0.432 |

Initial field tests that were conducted using the multi-layer softballs 10 produced in Example 1 yielded positive comments from athletes with different skill levels, ranging from players new to the game to players having played for as many as 25 years. The tests were conducted at Rivers Park in Chicopee, Mass. Variations #2 and #4 were compared to Dudley's WT12-RF softball, which is a 0.47 COR softball. Both of the multi-layer ball 10 samples were stitched with leather covers 16. The two central cores 12 were made with approximately 100 gram shot weights, which allowed the use of the heavier leather cover 16. Variation #2 was a 0.44 COR ball made with a 0.138 inch outer core layer, while variation #4 was a 0.47 COR ball with the same outer core layer thickness. All of the test balls 10 had a final weight (including the cover) of approximately 185 grams. The athletes were pitched 16 balls total in the following sequence: five control balls, three multi-layer balls (#4), five controls, and three multi-layer balls (#2). The players were then asked to fill out a questionnaire that compared the multi-layer softballs 10 to the controls. The survey focused on the feel of the new product on impact, the distance, the sound, the flight consistency, and any additional concerns or comments. In this initial test, both types of sample softballs were tested against the WT-12RF to avoid confusion. Later player tests compared 0.44 and 0.47 COR multi-layer core softballs versus control softballs at the same COR level.

The overwhelming response by the players was that the multi-layer softball 10 was softer than the traditional control ball, but traveled the same distance as the control. All of the participants felt that the flight of the ball 10 was consistent each time the ball 10 was hit. Players did notice a difference in the sound of the ball off the bat, commenting that there were "lower pitched sounds" and "less ping" when the ball 10 was struck. Some benefits of the multi-layer softball 10 that were mentioned included "the ball was slightly softer and easier to hit through." Additional comments referred to "less sting in the hands on miss-hits." The players' feedback did correlate well to the static data of the softballs. The multi-layer softball products had compressions that were just under 240 lbs., while the WT-12RF was just over 500 lbs. The COR values for the 0.47 COR multi-layer product was similar to the COR values of the 0.47 COR control ball at 40, 60, and 80 mph.

Example 2

Based on the data obtained using the balls 10 produced in Example 1, another set of multi-layer softballs 10 were produced, as shown in TABLE 4 below. The central cores 12 were made to be approximately 3.42 inches in diameter, and the outer mantle layer 14 was approximately 0.125 inches thick. The central core 12 was made with about a 115 gram shot weight (instead of a 100 gram shot weight as in Example 1), which increased the durability of the final product. The thinner outer mantle layer 15 increased the compression of the completed composite core 11, but maintained it at a level of under 325 lbs. for the final softball 10. The additional weight in the central core limited the weight, and therefore the type, of cover 16 used. The samples produced in Example 2 had a stitched composite leather cover 16 to obtain the proper finished ball weight. If a leather cover 16 is desired, the weight of the central core 12 or the density of the outer core material must be decreased.

As in Example 1, both 0.440 and 0.470 COR softballs 10 were made for testing. Two different urethane systems at two different mix ratios were used for each COR level. In this example, the central cores 12 were molded in the 88.5 mm molds and sanded down to a finished size of 3.41–3.43 inches, preferably about 3.42 inches.

TABLE 4

| | E | F | G | H |
|---|---|---|---|---|
| BASF Urethane System | Elastoflex 25066R | Elastoflex 25066R | Elastoflex 25063R | Elastoflex 25063R |
| C. O. R. | 0.440 | 0.440 | 0.470 | 0.470 |
| Mix Ratio | 100/71.5–100/72.0 | 100/75.0–100/75.5 | 100/66.0–100/66.5 | 100/69.0–100/69.5 |

TABLE 4-continued

| | E | F | G | H |
|---|---|---|---|---|
| Mold Size | 88.5 mm | 88.5 mm | 88.5 mm | 88.5 mm |
| Sanded Core Weight | 115–120 grams | 115–120 grams | 115–120 grams | 115–120 grams |
| Size Range of Sanded Cores | 3.410–3.430" | 3.410–3.430" | 3.410–3.430" | 3.410–3.430" |

Based on test results of the central cores 12, core types F and H were selected to have the outer mantle layer 14 molded over them. The outer mantle layer 14 was molded on the central core 12 using 94.2 mm molds with the modified pins. The outer mantle layer 14 was molded to have a thickness of about 0.125 to 0.135 inches. All mantle 14, 15 layers were molded using BASF's Elastocast™ urethane system. Composite covers 16 were then stitched over the multi-layer cores 11 to produce finished softballs for testing. The cores 12 and finished balls 10 were tested for size, weight, compression, COR and durability, and results are shown in TABLES 5 to 7 below.

TABLE 5

Central core 'F' (.44 COR Central core - 88.5 mm Mold) With Elastocast ™ Outer Layer

| Central core | Mantle Layer | Core No. | Weight (g) | Size Pole (in) | Size Eq. (in) | Comp. Pole (lbf) | Comp. Eq. (lbf) |
|---|---|---|---|---|---|---|---|
| F | Elastocast ™ | 1 | 160.8 | 3.668 | 3.680 | 320.3 | 295 |
| F | Elastocast ™ | 2 | 160.5 | 3.658 | 3.681 | 340.0 | 311.4 |
| F | Elastocast ™ | 3 | 158.9 | 3.661 | 3.671 | 300.1 | 280.5 |
| F | Elastocast ™ | 4 | 159.1 | 3.658 | 3.672 | 364.7 | 317.8 |
| F | Elastocast ™ | 5 | 163.6 | 3.669 | 3.677 | 323.6 | 323.3 |
| F | Elastocast ™ | 6 | 163.5 | 3.663 | 3.682 | 313.6 | 296.4 |
| | | Ave. | 161.1 | 3.663 | 3.677 | 315.6 | |

| Central core | Mantle Layer | Core No. | COR @ 40 mph | COR @ 60 mph | COR @ 80 mph | Durability |
|---|---|---|---|---|---|---|
| F | Elastocast ™ | 1 | 0.518 | 0.459 | 0.425 | 185 Blows |
| F | Elastocast ™ | 2 | 0.520 | 0.459 | 0.427 | 185 Blows |
| F | Elastocast ™ | 3 | 0.520 | 0.455 | 0.425 | |
| | | Ave. | 0.519 | 0.458 | 0.426 | |

0.44 COR Control WS-12RF80

| Ball # | Weight | Size Pole (in) | Size Eq. (in) | Comp. Pole | Comp. Eq. | COR @ 40 mph | COR @ 60 mph |
|---|---|---|---|---|---|---|---|
| 1 | 146.9 | 3.660 | 3.687 | 404.6 | 422.4 | 0.478 | 0.429 |
| 2 | 145.9 | 3.662 | 3.673 | 391.3 | 405.2 | 0.472 | 0.425 |
| 3 | 146.0 | 3.651 | 3.677 | 407.8 | 411.6 | 0.478 | 0.423 |
| Ave. | 146.3 | 3.658 | 3.679 | 407.2 | | 0.476 | 0.426 |

TABLE 6

Central core 'H' (0.47 COR Central core - 88.5 mm. Mold) With BASF Outer Layer

| Central core | Mantle Layer | Core No. | Weight (g) | Size Pole (in) | Size Eq. (in) | Comp. Pole (lbf) | Comp. Eq. (lbf) |
|---|---|---|---|---|---|---|---|
| H | Elastocast ™ | 1 | 160.8 | 3.663 | 3.675 | 347.0 | 299.4 |
| H | Elastocast ™ | 2 | 158.4 | 3.667 | 3.678 | 299.8 | 269.6 |
| H | Elastocast ™ | 3 | 160.6 | 3.665 | 3.678 | 315.5 | 280.6 |
| H | Elastocast ™ | 4 | 160.1 | 3.666 | 3.675 | 325.7 | 291.4 |
| H | Elastocast ™ | 5 | 162.3 | 3.679 | 3.677 | 339.9 | 292.1 |
| H | Elastocast ™ | 6 | 162.8 | 3.668 | 3.675 | 336.8 | 298.7 |
| | | Ave. | 160.8 | 3.668 | 3.676 | 308.0 | |

TABLE 6-continued

| Central core | Mantle Layer | Core No. | COR @ 40 mph | COR @ 60 mph | COR @ 80 mph | Durability |
|---|---|---|---|---|---|---|
| H | Elastocast ™ | 1 | 0.527 | 0.475 | 0.442 | 185 Blows |
| H | Elastocast ™ | 2 | 0.530 | 0.479 | 0.439 | 185 Blows |
| H | Elastocast ™ | 3 | 0.530 | 0.479 | 0.441 | |
| | | Ave. | 0.529 | 0.478 | 0.441 | |

0.47 COR Control - WT-12RF

| Ball # | Weight | Size Pole (in) | Size Eq. (in) | Comp. Pole | Comp. Eq. | COR @ 40 mph | COR @ 60 mph | COR @ 80 mph |
|---|---|---|---|---|---|---|---|---|
| 1 | 145.5 | 3.680 | 3.680 | 454.6 | 434.6 | 0.520 | 0.466 | 0.435 |
| 2 | 146.4 | 3.680 | 3.680 | 429.0 | 438.1 | 0.524 | 0.471 | 0.434 |
| 3 | 146.8 | 3.675 | 3.683 | 421.8 | 434.0 | 0.514 | 0.465 | 0.434 |
| Ave. | 146.2 | 3.678 | 3.681 | 435.4 | | 0.519 | 0.467 | 0.434 |

TABLE 7

| Ball No. | Weight (g) | Size Pole (in) | Size Eq. (in) | Comp. Pole (lbf) | Comp. Eq. (lbf) | COR | Durability |
|---|---|---|---|---|---|---|---|
| Multi-Layer: Variation F Central core/Elastocast ™ Outer Layer - 0.44 COR - White ZN Composite Cover | | | | | | | |
| 1 | 186.3 | 12" | 11 15/16" | 251.4 | 277.9 | 0.465 | 185 Blows |
| 2 | 183.6 | 11 15/16" | 11 15/16" | 274.8 | 269.6 | 0.458 | Good |
| 3 | 185.5 | 11 15/16" | 12" | 239.8 | 245.5 | 0.459 | |
| Ave. | 185.1 | 11 15/16" | 11 15/16" | 259.8 | | 0.461 | |
| A dozen of these balls were used in the player test. During the test, the athletes put 8 to 80 blows on each ball. Two of these balls were then subjected to 185 blows in the Spalding pound test machine in 30 blow increments. The balls held up well and did not show any significant out of round. | | | | | | | |
| 0.44 COR Control - WS-12RF80 | | | | | | | |
| 1 | 186.8 | 12" | 12" | 381.4 | 378.6 | 0.418 | |
| 2 | 184.9 | 12" | 12" | 384.8 | 379.9 | 0.417 | |
| 3 | 185.5 | 12" | 12" | 393.3 | 386.6 | 0.419 | |
| Ave. | 185.7 | 12" | 12" | 384.1 | | 0.418 | N/A |
| Multi-Layer: Variation H Central core/Elastocast ™ Outer Layer - 0.47 COR - White ZN Composite Cover | | | | | | | |
| 1 | 186.9 | 11 15/16" | 11 15/16" | 226.8 | 239.2 | 0.476 | 185 Blows |
| 2 | 186.3 | 11 15/16" | 11 15/16" | 242.2 | 238.5 | 0.475 | Good |
| 3 | 184.5 | 12" | 11 15/16" | 237.5 | 226.7 | 0.479 | |
| Ave. | 185.9 | 11 15/16" | 11 15/16" | 235.2 | | 0.477 | |
| A dozen of these balls were used in the player test. During the test, the athletes put 8 to 80 blows on each ball. Two of these balls were then subjected to 190 blows in the Spalding pound test machine in 30 blow increments. The balls held up well and did not show any significant out of round. | | | | | | | |
| 0.47 COR Control - WT-12RF | | | | | | | |
| 1 | 187.9 | 12" | 12" | 451.9 | 453.5 | 0.464 | |
| 2 | 190.0 | 12" | 12" | 444.4 | 429.0 | 0.462 | |
| 3 | 188.6 | 12" | 12" | 445.7 | 424.3 | 0.463 | |
| Ave. | 188.8 | 12" | 12" | 441.5 | | 0.463 | N/A |

The final softballs 10 were then field tested to determine the playability of the new multi-layer softball 10 of the invention. The focus of the field test was to obtain feedback on the feel, performance, sound, flight characteristics, distance, durability, and consistency of the product verses a comparable Dudley control softball. The players that participated in the trial were AA—Majors competitive level players. Field test results are shown below in Tables 8 to 10. Tables 8 and 9 show individual hitting and distance results using the 0.44 COR and 0.47 COR softballs, and Table 10 shows the combined distance results from all participants for both types of softballs. The field test procedure used is as follows:

Players warmed up with the test balls 10. Players were asked to comment on the feel of the ball 10 during the throwing and catching session by answering several questions about the feel of the ball 10.

Following the informal throwing portion of the test, each player participated in the batting portion of the study.

Each player took 24 swings per round with two to four rounds per athlete. The multi-layer softballs 10 and the control softballs were pitched in somewhat random fashion so that each player hit 6 controls, 6 multi-layers, 6 controls, and then 6 multi-layers. All balls hit over a minimum distance of 300 feet as determined by a range finder (Bushnell Yardage Pro range finder) were recorded. The 300 foot distance is a means of controlling the flight trajectory of the hit ball when tabulating and comparing distance measurements for each type of ball, and it groups the distance data and allows for better statistical representation. Hits that did not travel the required minimum distance were omitted. Ground balls were designated 'GND', line drives were denoted 'LNR', and pop ups were labeled 'POP'. Each athlete was asked to provide feedback on the feel of the ball off the bat, the flight of the ball, the sound of impact, and the consistency of the product from swing to swing using the following questions:

How did the ball feel during the throwing and catching portion of the test? Did the ball feel like a traditional softball?

How did the ball feel upon impact with the bat? Did the ball feel solid upon impact?

How would you rate the liveliness of the new product verses the Dudley control? Did the ball jump off the bat?

Did the new product sting less, more or the same as the control ball when you hit it?

How did the new product sound when it was struck (i.e., crack off the bat)? Was it any different than the control ball?

If so, do you think the sound was acceptable?

How was the flight path of the new product verses the control? Did the ball fly straight after contact? Was there any excessive knuckling of the ball through the air?

How would you rate the distance of the new product verses the control?

TABLE 8

0.44 COR vs. Control - Individual Distances Recorded

| Test Prod. | Multi-Layer Softballs White ZN Composite Cover Gold Stitch COR 0.44 | Controls | Dudley Thunder Heat WS-12RF80 Poly Core Synthetic Cover, Gold Stitch COR 0.44 Comp. ~385 lbs. | | |
|---|---|---|---|---|---|
| Test Site | Soddy Daisy, TN | | | | |
| Field | South Park | | | | |
| Weather | 85° F., Sunny, Relatively No wind | | | | |
| Date | Sunday Jun. 16, 2002 | | | | |
| Player # | 1 | | Player # | 2 | |
| Bat Type | Mizuno Rage 28 oz | | Bat Type | Easton Trishell 30 oz. | |
| Ball Number | Control | 0.44 Multi-Layer | Ball Number | Control | 0.44 Multi-Layer |
| 1 | GND | 306 | 1 | POP | 330 |
| 2 | LNR | GND | 2 | LNR | POP |
| 3 | POP | 378 | 3 | POP | 324 |
| 4 | GND | 300 | 4 | POP | LNR |
| 5 | POP | 318 | 5 | 360 | 381 |
| 6 | 387 | 390 | 6 | 309 | LNR |
| 7 | POP | 384 | 7 | POP | LNR |
| 8 | POP | GND | 8 | 303 | 393 |
| 9 | 384 | 330 | 9 | POP | 300 |
| 10 | 300 | 402 | 10 | GND | 315 |
| 11 | 303 | 381 | 11 | 312 | 300 |
| 12 | 303 | 381 | 12 | POP | 318 |
| Average Distance | 335.4 | 357 | Average Distance | 321 | 332.6 |
| Std. Dev. | 45.76 | 38.78 | Std. Dev. | 26.27 | 35.29 |
| Longest Hit | 387 | 402 | Longest Hit | 360 | 393 |
| Ave of Top 3 Hits | 358 | 392 | Ave of Top 3 Hits | 327 | 368 |
| Notes: | | | Notes: | | |
| No significant out of round or denting on the balls after testing. | | | No significant out of round or denting on the balls after testing. | | |
| Player # | 3 | | Player # | 4 | |
| Bat Type | Worth PST 28 oz. | | Bat Type | Worth PST 137 28 oz and Mizuno Techfire | |
| Ball Number | Control | 0.44 Multi-Layer | Ball Number | Control | 0.44 Multi-Layer |
| 1 | GND | GND | 1 | POP | 387 |
| 2 | GND | LNR | 2 | 363 | POP |

TABLE 8-continued 0.44 COR vs. Control - Individual Distances Recorded

| | | | | | |
|---|---|---|---|---|---|
| 3 | 324 | LNR | 3 | 324 | 321 |
| 4 | POP | GND | 4 | 372 | GND |
| 5 | LNR | GND | 5 | 330 | LNR |
| 6 | 318 | 345 | 6 | 306 | 384 |
| 7 | LNR | 330 | 7 | 309 | GND |
| 8 | LNR | 324 | 8 | LNR | 390 |
| 9 | GND | LNR | 9 | 324 | 306 |
| 10 | 387 | LNR | 10 | LNR | LNR |
| 11 | 345 | 336 | 11 | 318 | 306 |
| 12 | LNR | LNR | 12 | 312 | 333 |
| Average Distance | 343.5 | 333.8 | Average Distance | 328.7 | 346.7 |
| Std. Deviation | 31.22 | 8.96 | Std. Deviation | 23.44 | 38.84 |
| Longest Hit | 387 | 345 | Longest Hit | 372 | 390 |
| Ave of Top 3 Hits | 352 | 337 | Ave of Top 3 Hits | 355 | 387 |
| Notes: | | | Notes: | | |
| No significant out of round or denting on the balls after testing. | | | No significant out of round or denting on the balls after testing. | | |
| Player # | 5 | | Player # | 6 | |
| Bat Type | Worth PST 28 oz. | | Bat Type | Worth PST 137 28 oz. | |
| Ball Number | Control | 0.44 Multi-Layer | Ball Number | Control | 0.44 Multi-Layer |
| 1 | 318 | 402 | 1 | POP | GND |
| 2 | 345 | 327 | 2 | POP | 315 |
| 3 | 315 | LNR | 3 | 318 | GND |
| 4 | GND | 408 | 4 | 396 | 312 |
| 5 | GND | 321 | 5 | 366 | LNR |
| 6 | LNR | LNR | 6 | 375 | LNR |
| 7 | 321 | 390 | 7 | 369 | 375 |
| 8 | 342 | 381 | 8 | 381 | LNR |
| 9 | POP | 390 | 9 | LNR | 423 |
| 10 | 330 | LNR | 10 | 369 | POP |
| 11 | GND | 387 | 11 | 324 | GND |
| 12 | 372 | 387 | 12 | 324 | GND |
| Average Distance | 334.7 | 377 | Average Distance | 358 | 356 |
| Std. Deviation | 20.11 | 31.18 | Std. Deviation | 28.46 | 53.12 |
| Longest Hit | 372 | 408 | Longest Hit | 396 | 423 |
| Ave of Top 3 Hits | 353 | 400 | Ave of Top 3 Hits | 384 | 371 |
| Notes: | | | Notes: | | |
| No significant out of round or denting on the balls after testing. | | | No significant out of round or denting on the balls after testing. | | |
| Player # | 7 | | | | |
| Bat Type | Worth PST 137 28 oz. | | | | |
| Ball # | Control | 0.44 Multi-Layer | | | |
| 1 | 312 | LNR | Legend: | | |
| 2 | 372 | LNR | GND = Grounder | | |
| 3 | 318 | POP | LNR = Liner | | |
| 4 | 357 | GND | POP = Pop Fly | | |
| 5 | 375 | 390 | | | |
| 6 | 384 | 306 | | | |
| 7 | 363 | 372 | | | |
| 8 | 354 | LNR | | | |
| 9 | 369 | 366 | | | |
| 10 | 378 | 408 | | | |
| 11 | 306 | 378 | | | |
| 12 | 315 | 321 | | | |
| Ave. Dist. | 350.3 | 363 | | | |
| Std. Dev. | 29.03 | 36.70 | | | |
| Longest Hit | 384 | 408 | | | |
| Ave of Top 3 Hits | 378 | 392 | | | |
| Notes: | | | | | |

No significant out of round or denting on the balls after testing.
Between 7 and 10 hits are on the balls up to this point.

TABLE 9

0.47 COR vs. Control
Individual Distance Recorded

| Test Prod. | Multi-Layer Softballs White ZN Composite Cover Red Stitch COR 0.47 | | Control | Dudley Thunder Heat WT12-RF Poly Core White Leather Cover, Red Stitch COR 0.47 Comp. ~440 lbs. | |
|---|---|---|---|---|---|
| Player # | 1 | | Player # | 2 | |
| Bat Type | Worth PST 28 oz. | | Bat Type | Worth Trishell 30 oz. | |
| Ball # | Control | 0.47 Multi-Layer | Ball # | Control | 0.47 Multi-Layer |
| 1 | GND | 378 | 1 | 315 | GND |
| 2 | GND | GND | 2 | 318 | POP |
| 3 | GND | 312 | 3 | 327 | 345 |
| 4 | Foul | GND | 4 | POP | 345 |
| 5 | LNR | 330 | 5 | POP | 366 |
| 6 | LNR | 363 | 6 | 330 | 336 |
| 7 | 312 | FOUL | 7 | 318 | 357 |
| 8 | 324 | GND | 8 | GND | POP |
| 9 | GND | 399 | 9 | LNR | 369 |
| 10 | 360 | 375 | 10 | POP | 378 |
| 11 | LNR | 363 | 11 | 300 | POP |
| 12 | GND | 399 | 12 | 336 | POP |
| Ave. Dist. | 332 | 364.9 | Ave. Dist. | 320.6 | 356.6 |
| Std. Dev. | 24.98 | 30.76 | Std. Dev. | 11.80 | 15.24 |
| Longest Hit | 360 | 399 | Longest Hit | 336 | 378 |
| Ave of Top 3 Hits | 332 | 392 | Ave of Top 3 Hits | 331 | 371 |
| Notes: | | | Notes: | | |
| No significant out of round or denting on the balls after testing. | | | No significant out of round or denting on the balls after testing. | | |
| Player # | 3 | | Player # | 4 | |
| Bat Type | Worth PST 28 oz | | Bat Type | Mizuno Techfire | |
| Ball # | Control | 0.47 Multi-Layer | Ball # | Control | 0.47 Multi-Layer |
| 1 | 315 | 315 | 1 | LNR | 324 |
| 2 | LNR | LNR | 2 | 327 | 327 |
| 3 | LNR | LNR | 3 | 363 | GND |
| 4 | 336 | 369 | 4 | 345 | 315 |
| 5 | 372 | LNR | 5 | 321 | 318 |
| 6 | 363 | 405 | 6 | 327 | 336 |
| 7 | 360 | POP | 7 | 330 | 306 |
| 8 | 318 | GND | 8 | LNR | 336 |
| 9 | LNR | 354 | 9 | 318 | LNR |
| 10 | 345 | GND | 10 | Foul | 318 |
| 11 | 366 | 342 | 11 | LNR | POP |
| 12 | 306 | GND | 12 | 318 | 345 |
| Ave. Dist. | 342.3 | 357 | Ave. Dist. | 331 | 325 |
| Std. Dev. | 24.71 | 33.34 | Std. Dev. | 15.54 | 12.28 |
| Longest Hit | 372 | 405 | Longest Hit | 363 | 345 |
| Ave Top 3 Hits | 367 | 376 | Ave Top 3 Hits | 346 | 339 |
| Notes: | | | Notes: | | |

TABLE 9-continued 0.47 COR vs. Control
Individual Distance Recorded

| | | | | | |
|---|---|---|---|---|---|
| No significant out of round or denting on the balls after testing. | | | No significant out of round or denting on the balls after testing. Between 8 and 10 hits per ball are on the balls up to this point. | | |
| Player # | 5 | | Player # | 6 | |
| Bat Type | Worth PST 28 oz | | Bat Type | Worth PST 137 28 oz | |
| Ball # | Control | 0.47 Multi-Layer | Ball # | Control | 0.47 Multi-Layer |
| 1 | GND | 402 | 1 | GND | 375 |
| 2 | GND | 393 | 2 | LNR | LNR |
| 3 | 324 | LNR | 3 | GND | GND |
| 4 | 321 | LNR | 4 | LNR | LNR |
| 5 | 372 | LNR | 5 | GND | 375 |
| 6 | 306 | 369 | 6 | LNR | LNR |
| 7 | 312 | GND | 7 | LNR | GND |
| 8 | 324 | 324 | 8 | LNR | LNR |
| 9 | 318 | 372 | 9 | GND | GND |
| 10 | POP | 408 | 10 | LNR | GND |
| 11 | 318 | LNR | 11 | 378 | LNR |
| 12 | POP | LNR | 12 | 336 | LNR |
| Ave. Dist. | 324 | 378 | Ave. Dist. | 357 | 375 |
| Std. Dev. | 20.18 | 30.77 | Std. Dev. | 29.70 | 0.00 |
| Longest Hit | 372 | 408 | Longest Hit | 378 | 375 |
| Ave Top 3 Hits | 340 | 401 | Ave Top 3 Hits | — | — |
| Notes: | | | Notes: | | |
| No significant out of round or denting on the balls after testing. | | | No significant out of round or denting on the balls after testing. | | |
| Player # | 7 | | Player # | 8 | |
| Bat Type | Worth PST 137 28 oz. | | Bat Type | Mizuno Techfire | |
| Ball # | Control | 0.47 Multi-Layer | Ball # | Control | 0.47 Multi-Layer |
| 1 | 327 | GND | 1 | 363 | 366 |
| 2 | 321 | 336 | 2 | LNR | 327 |
| 3 | GND | 372 | 3 | GND | LNR |
| 4 | GND | LNR | 4 | 366 | GND |
| 5 | 399 | LNR | 5 | GND | LNR |
| 6 | 369 | 390 | 6 | LNR | GND |
| 7 | LNR | 393 | 7 | LNR | GND |
| 8 | GND | 378 | 8 | GND | GND |
| 9 | 336 | POP | 9 | 345 | 405 |
| 10 | 321 | 378 | 10 | LNR | GND |
| 11 | 318 | 315 | 11 | GND | GND |
| 12 | 315 | LNR | 12 | 318 | LNR |
| Ave. Dist. | 338.3 | 366 | Ave. Dist. | 348 | 366 |
| Std. Dev. | 30.03 | 29.24 | Std. Dev. | 22.05 | 39.00 |
| Longest Hit | 399 | 393 | Longest Hit | 366 | 405 |
| Ave Top 3 Hits | 368 | 387 | Ave Top 3 Hits | 358 | 366 |
| Notes: | | | Notes: | | |
| No significant out of round or denting on the balls after testing. | | | No significant out of round or denting on the balls after testing. | | |

TABLE 10

Total Distance Statistics

| | | | |
|---|---|---|---|
| Test Products | Multi-Layer Softballs | Controls | Dudley Thunder Heat |
| | White ZN Composite Cover Gold Stitch COR 0.44 | | WS-12RF80 Poly Core Synthetic Cover, Gold Stitch COR 0.44 Comp. ~385 lbs. |
| Test Products | Multi-Layer Softballs | Controls | Dudley Thunder Heat |
| | White ZN Composite Cover | | WT12-RF Poly Core |
| | Red Stitch | | White Leather Cover, Red Stitch |

TABLE 10-continued

Total Distance Statistics

| | COR 0.47 | | | COR 0.47 Comp. ~440 lbs. | |
|---|---|---|---|---|---|
| | 0.44 COR Products | | | 0.47 COR Products | |
| Hit Number | Control | 0.44 Multi-Layer | Hit Number | Control | 0.47 Multi-Layer |
| 1 | 396 | 423 | 1 | 399 | 408 |
| 2 | 387 | 408 | 2 | 378 | 405 |
| 3 | 387 | 408 | 3 | 372 | 402 |
| 4 | 384 | 402 | 4 | 372 | 399 |
| 5 | 384 | 402 | 5 | 369 | 399 |
| 6 | 381 | 393 | 6 | 366 | 393 |
| 7 | 378 | 390 | 7 | 363 | 393 |
| 8 | 375 | 390 | 8 | 363 | 390 |
| 9 | 375 | 390 | 9 | 360 | 378 |
| 10 | 372 | 390 | 10 | 360 | 378 |
| 11 | 372 | 390 | 11 | 345 | 378 |
| 12 | 372 | 387 | 12 | 345 | 378 |
| 13 | 369 | 387 | 13 | 336 | 375 |
| 14 | 369 | 387 | 14 | 336 | 375 |
| 15 | 369 | 384 | 15 | 336 | 375 |
| 16 | 366 | 384 | 16 | 336 | 372 |
| 17 | 363 | 381 | 17 | 330 | 372 |
| 18 | 363 | 381 | 18 | 330 | 369 |
| 19 | 360 | 381 | 19 | 327 | 369 |
| 20 | 357 | 381 | 20 | 327 | 369 |
| 21 | 354 | 378 | 21 | 327 | 366 |
| 22 | 345 | 378 | 22 | 327 | 363 |
| 23 | 345 | 375 | 23 | 324 | 363 |
| 24 | 342 | 372 | 24 | 324 | 357 |
| 25 | 330 | 366 | 25 | 324 | 354 |
| 26 | 330 | 345 | 26 | 321 | 345 |
| 27 | 324 | 336 | 27 | 321 | 345 |
| 28 | 324 | 333 | 28 | 321 | 345 |
| 29 | 324 | 330 | 29 | 321 | 342 |
| 30 | 324 | 330 | 30 | 318 | 336 |
| 31 | 324 | 330 | 31 | 318 | 336 |
| 32 | 321 | 327 | 32 | 318 | 336 |
| 33 | 318 | 324 | 33 | 318 | 336 |
| 34 | 318 | 324 | 34 | 318 | 330 |
| 35 | 318 | 321 | 35 | 318 | 327 |
| 36 | 318 | 321 | 36 | 318 | 324 |
| 37 | 318 | 321 | 37 | 318 | 324 |
| 38 | 315 | 318 | 38 | 315 | 318 |
| 39 | 315 | 318 | 39 | 315 | 318 |
| 40 | 312 | 315 | 40 | 315 | 315 |
| 41 | 312 | 315 | 41 | 312 | 315 |
| 42 | 312 | 312 | 42 | 312 | 315 |
| 43 | 309 | 306 | 43 | 306 | 312 |
| 44 | 309 | 306 | 44 | 306 | 306 |
| 45 | 306 | 306 | 45 | 300 | |
| 46 | 306 | 306 | | | |
| 47 | 303 | 300 | | | |
| 48 | 303 | 300 | | | |
| 49 | 303 | 300 | | | |
| 50 | 300 | | | | |

| | Control | 0.44 Multi-Layer | | Control | 0.47 ML |
|---|---|---|---|---|---|
| Ave. Dist. All Hits | 341 | 354 | Ave. Dist. All Hits | 333 | 357 |
| Std. Dev. | 30 | 37 | Std. Dev. | 23 | 29 |
| Max. Dist. | 396 | 423 | Max. Dist, | 399 | 408 |
| Average of Top 3 Hits | 390 | 413 | Average of Top 3 Hits | 383 | 405 |
| Average of Top 5 Hits | 388 | 409 | Average of Top 5 Hits | 378 | 403 |
| Average of Top 10 Hits | 382 | 400 | Average of Top 10 Hits | 370 | 395 |
| Average of Top 15 Hits | 378 | 395 | Average of Top 15 Hits | 360 | 388 |
| Average of Top 20 Hits | 374 | 392 | Average of Top 20 Hits | 353 | 384 |

Additional testing was performed on another batch of softballs 10. The softballs 10 were constructed in the manner previously described at both the 0.44 and 0.47 COR levels. The central cores 12 were produced using urethane available in Taiwan under the designations T11-0.40 and T11-0.44 respectively. The central core 12 of the 0.44 COR multi-layer ball 10 was produced using a mix ratio of about 100/52, and the central core 12 of the 0.47 COR ball 10 was produced using a mix ratio of about 100/54. The thickness of the outer mantle layer 14 was 0.125–0.135 inches, and the outer mantle layer 14 was molded using a mold size of 94.2 mm. Mantle layers 14, 15 for both balls 10 were molded using the BASF Elastocast 70018R system with WUC 3236T isocyanate. Measurements of the softballs were taken, and results are shown below in TABLES 11 and 12.

TABLE 11

0.44 COR Multi-Layer Finished Balls Made

Finished Ball
Dudley Thunder Advance MLT 12 44
White ZN Composite Cover
0.44 COR Version

| Core No. | Size Pole (in) | Weight (g) | Comp. Pole (lbf) | Comp. Eq. (lbf) | COR | 30 Blow Durability (60, 90, 120) | 185 Blow Durability |
|---|---|---|---|---|---|---|---|
| 1 | 12" | 182.3 | 218.7 | 184.4 | 0.445 | — | — |
| 2 | 12" | 184.3 | 267.8 | 261.1 | 0.438 | — | — |
| 3 | 12" | 181.4 | 227.4 | 220.8 | — | Good after 30 blows | |
| 4 | 12" | 180.2 | 230.4 | 239.8 | — | Good after 30 blows | Good - No Cracking |
| 5 | 12" | 186.9 | 289.5 | 274.7 | — | Cover and Mantle Removed — Core Data Below | — |
| 6 | 12" | 184.0 | 263.4 | 257.0 | — | Cover and Mantle Removed — Core Data Below | — |
| 7 | — | — | 256.30 | 228.30 | — | — | — |
| 8 | — | — | 232.70 | 230.20 | — | — | — |
| 9 | — | — | 282.70 | 257.60 | — | — | — |
| 10 | — | — | 295.60 | 299.80 | — | — | — |
| 11 | — | — | 269.90 | 262.60 | — | — | — |
| 12 | — | — | 206.90 | 217.50 | — | — | — |
| Average | 12" | 183.2 | 249.0 | | 0.442 | Good | Good |
| Min. | 0.000 | 180.2 | 184.4 | | 0.438 | | |
| Max. | 0.000 | 186.9 | 299.8 | | 0.445 | | |

Cover to Mantle Adhesion was pretty good. The cover could be peeled without much force. Mantle to Core Adhesion was very good.

Central core Data - Changes Over Time

| Core Number | Weight (g) | First Test Comp. Pole (lbf) | First Test Comp. Eq. (lbf) | First Test COR | Second Test (after 3 days) Comp. Pole (lbf) | Second Test (after 3 days) Comp. Eq. (lbf) | Second Test COR | Third Test (after 1 week) COR |
|---|---|---|---|---|---|---|---|---|
| 5 | 123.2 | 406.6 | 380.8 | 0.431 | 446.8 | 443.5 | 0.433 | 0.433 |
| 6 | 120.6 | 372.7 | 392.8 | 0.429 | 418.0 | 424.6 | 0.431 | 0.436 |
| Average | 121.9 | 388.2 | | 0.430 | 433.2 | | 0.432 | 0.435 |
| Completed Balls - Changes Over Time | | | | | | | | |
| 1 | 182.3 | 218.7 | 184.4 | 0.445 | 234.5 | 197.3 | 0.450 | 0.443 |
| 2 | 184.3 | 267.8 | 261.1 | 0.438 | 293.0 | 281.5 | 0.439 | 0.435 |
| 7 | — | — | — | — | 287.3 | 258.2 | 0.439 | 0.438 |
| 8 | — | — | — | — | 262.2 | 245.6 | 0.440 | 0.438 |
| Average | 183.3 | 233.0 | | 0.442 | 257.5 | | 0.442 | 0.439 |

TABLE 12

Statics for 0.47 COR Multi-Layer Finished Balls

Finished Ball
Dudley Thunder Advance MLT 12 RF
White ZN Composite Cover
0.47 COR Version TABLE 12-continued

| Statics for 0.47 COR Multi-Layer Finished Balls | | | | | | | |
|---|---|---|---|---|---|---|---|
| Core No. | Size Pole (in) | Weight (g) | Comp. Pole (lbf) | Comp. Eq. (lbf) | COR | 30 Blow Durability (60, 90, 120) | 185 Blow Durability |
| 1 | 12" | 181.2 | 204.6 | 198.3 | 0.445 | — | — |
| 2 | 12" | 182.8 | 222.6 | 223.2 | 0.446 | — | — |
| 3 | 12" | 181.7 | 205.9 | 205.5 | 0.448 | — | — |
| 4 | 12" | 183.2 | 208.9 | 202.1 | — | Good after 30 Blows | Good |
| 5 | 12" | 182.3 | 211.7 | 206.7 | — | — | — |
| 6 | 12" | 181.8 | 211.8 | 222.8 | — | — | — |
| Ave. | 12" | 182.2 | 210.3 | | 0.446 | Good | Good |
| Min. | 0.000 | 181.2 | 198.3 | | 0.445 | | |
| Max. | 0.000 | 183.2 | 223.2 | | 0.448 | | |
| Original Data | | | | | | | |
| Dudley Thunder Advance MLT 12 44 | | | | | | | |
| White ZN Composite Cover 0.44 COR Version | | | | | | | |
| 1 | 12" | 183.8 | 229.7 | 222.4 | 0.455 | Good | Good |
| 2 | 12" | 186.7 | 230.4 | 240.2 | 0.454 | Good | |
| 3 | 12" | 183.8 | 209.4 | 223.1 | — | — | — |
| 4 | 12" | 185.4 | 249.1 | 205.4 | — | — | — |
| 5 | 12" | 187.4 | 233.9 | 223.4 | — | — | — |
| 6 | 12" | 180.8 | 200.2 | 201.8 | — | — | — |
| 7 | — | 181.9 | 232.2 | 227.7 | — | — | — |
| 8 | — | 183.9 | 241.8 | 241.7 | — | — | — |
| 9 | — | 186.8 | 216.9 | 214.9 | — | — | — |
| 10 | — | 186.6 | 224.7 | 227.8 | — | — | — |
| 11 | — | 184.6 | 232.7 | 237.0 | — | — | — |
| 12 | — | 182.3 | 207.8 | 212.4 | — | — | — |
| Ave. | 12" | 184.5 | 224.4 | | 0.455 | Good | |
| Min. | 0.000 | 180.8 | 200.2 | | 0.454 | | |
| Max. | 0.000 | 187.4 | 249.1 | | 0.455 | | |

The softballs 10 were tested in a manner similar to those tested in Example 2. There were 4 different balls tested: a control (Dudley Thunder SW-12RF80 Softball); the 0.44 COR version multi-layer ball 10 (Dudley Thunder Advance); the 0.47 COR version multi-layer ball 10 (Dudley Thunder Advance); and the 0.44 COR version of the multi-layer ball 10 of Example 2 (Dudley Innova). The Dudley Innova was used to compare the final version to the first version of the multi-layer ball, which had a COR that was slightly high. Each player was asked to take 24 swings per round, with two rounds. The four ball types were pitched in random fashion, with each player hitting 6 balls of each type before moving to the next ball type. The Dudley Innova balls were later removed as players began to tire. All distances over 225 feet were recorded, in the same manner as the previous test. Test data on the four balls types is shown in TABLE 13 below. Results of the test are shown below in TABLE 14.

TABLE 13

Static Summary for Balls Used in Player Test (tested prior to test)

A
Dudley Thunder Heat CONTROL BALL
SW-12RF80 Poly Core
Synthetic Cover, Gold Stitch
COR 0.44 - Control

| Sample ID | Size (in) | Weight | Comp Pole (lbs) | Comp Eq. (lbs) | COR |
|---|---|---|---|---|---|
| A | 12 | 183.5 | 373.7 | 379.3 | 0.427 |
| A | 12 | 184.8 | 380.7 | 386.3 | 0.413 |
| A | 12 | 187.0 | 378.4 | 382.1 | — |
| A | 12 | 185.9 | 375.7 | 387.6 | — |
| A | 12 | 183.9 | 378.8 | 405.6 | — |

TABLE 13-continued

Static Summary for Balls Used in Player Test (tested prior to test)

| | | | | | |
|---|---|---|---|---|---|
| A | 12 | 186.9 | 387.1 | 393.5 | — |
| Average | 12 | 185.3 | 384.1 | | 0.420 |

Central core Weight is 142.6 grams (based on 2 cores).
Central core Compression is 437 lbs (based on 2 cores).
Central core COR is .436 (based on 2 cores).
B
Multi-Layer Softballs: Dudley Thunder Advance
White ZN Composite Cover
Gold Stitch
COR 0.44

| Sample ID | Size (in) | Weight | Comp Pole (lbs) | Comp Eq. (lbs) | COR |
|---|---|---|---|---|---|
| B | 12 | 185.1 | 283.1 | 279.5 | 0.437 |
| B | 12 | 184.3 | 211.2 | 206.3 | 0.438 |
| B | 12 | 182.2 | 328.3 | 309.7 | — |
| B | 12 | 183.1 | 270.6 | 257.6 | — |
| B | 12 | 187.1 | 274.0 | 271.2 | — |
| B | 12 | 187.6 | 322.5 | 303.1 | — |
| Average | 12 | 184.9 | 276.4 | | 0.438 |

Central core Weight is 121.4 grams (based on 2 cores).
Central core Compression is 457.9 lbs (based on 2 cores).
Central core COR is .433 (based on 2 cores).
Mantle Weight is 158 grams (based on 2 mantles).
Mantle Compression is 319 lbs (based on 2 mantles).
Mantle COR is .437 (based on 2 mantles).
C
Multi-Layer Softballs: Dudley Innova
White ZN Composite Cover
Gold Stitch
COR 0.44

TABLE 13-continued

Static Summary for Balls Used in Player Test (tested prior to test)

| Sample ID | Size (in) | Weight | Comp Pole (lbs) | Comp Eq. (lbs) | COR |
|---|---|---|---|---|---|
| C | 12 | 184.8 | 299.3 | 305.9 | 0.467 |
| C | 12 | 184.4 | 315.6 | 319.0 | — |
| C | 12 | 182.9 | 358.3 | 359.7 | — |
| C | 12 | 182.5 | 318.7 | 283.6 | — |
| C | 12 | 184.4 | 343.4 | 309.4 | — |
| C | 12 | 181.4 | 333.3 | 368.6 | — |
| Average | 12 | 183.4 | 326.2 | | 0.467 |

Central core Weight is 118 grams (based on 1 core).
Central core Compression is 667 lbs (based on 1 core).
Central core COR is .467 (based on 1 core).
Mantle Weight is 163.4 grams (based on 1 mantle).
Mantle Compression is 472 lbs (based on 1 mantle).
Mantle COR is .468 (based on 1 mantle).
D
Multi-Layer Softballs: Dudley Thunder Advance
White ZN Composite Cover
Red Stitch
COR 0.47

| Sample ID | Size (in) | Weight | Comp Pole (lbs) | Comp Eq. (lbs) | COR |
|---|---|---|---|---|---|
| D | 12 | 180.6 | 229.9 | 234.0 | 0.452 |
| D | 12 | 181.7 | 240.8 | 226.0 | 0.448 |
| D | 12 | 182.2 | 233.2 | 232.0 | — |
| D | 12 | 181.3 | 221.5 | 221.8 | — |
| D | 12 | 181.2 | 208.7 | 210.0 | — |
| D | 12 | 179.5 | 222.5 | 226.4 | — |
| Average | 12 | 181.1 | 225.6 | | 0.450 |

Central core Weight is 116.2 grams (based on 1 core).
Central core Compression is 530.1 lbs (based on 1 core).
Central core COR is .442 (based on 1 core).
Mantle Weight is 158.9 grams (based on 2 mantles).
Mantle Compression is 319 lbs (based on 2 mantles).
Mantle COR is .449 (based on 2 mantles).

TABLE 14

Individual Recorded Distances

| A | B |
|---|---|
| Control Ball (no mantle layer) (Standard 12" Urethane core)<br>Dudley Thunder Heat Synthetic Cover, Gold Stitch<br>COR 0.44<br>Comp.<br>~385 lbs. | Multi-Layer Softballs: Dudley Thunder Advance (core and mantle layer)<br>White ZN Composite Cover, Gold Stitch<br>COR 0.44 |
| **C** | **D** |
| Multi-Layer Softballs: Dudley Innova<br>White ZN Composite Cover<br>Gold Stitch<br>COR 0.44 | Multi-Layer Softballs: Dudley Thunder Advance<br>White ZN Composite Cover<br>Red Stitch<br>COR 0.47 |

Summary - Distance In Feet

| Ball Number | A SW-12RF80 Control | B Thunder Advance: MLT 44 | C Innova MLT 44 | D Thunder Advance MLT 47 |
|---|---|---|---|---|
| 1 | 354 | 387 | 381 | 363 |
| 2 | 345 | 387 | 381 | 357 |
| 3 | 342 | 378 | 369 | 348 |
| 4 | 336 | 366 | 357 | 345 |
| 5 | 330 | 360 | 354 | 345 |
| 6 | 327 | 354 | 351 | 342 |
| 7 | 327 | 345 | 333 | 342 |
| 8 | 321 | 345 | 333 | 336 |
| 9 | 321 | 342 | 333 | 333 |
| 10 | 318 | 336 | 327 | 333 |
| 11 | 318 | 327 | 327 | 333 |
| 12 | 318 | 327 | 324 | 324 |
| 13 | 315 | 324 | 321 | 324 |
| 14 | 312 | 324 | 315 | 321 |
| 15 | 309 | 324 | 309 | 318 |
| 16 | 309 | 324 | 303 | 315 |
| 17 | 309 | 321 | 300 | 315 |
| 18 | 306 | 321 | 297 | 306 |
| 19 | 303 | 318 | 285 | 306 |
| 20 | 300 | 318 | 279 | 306 |
| 21 | 300 | 315 | 276 | 306 |
| 22 | 297 | 315 | 273 | 303 |
| 23 | 297 | 312 | 264 | 303 |
| 24 | 294 | 312 | 264 | 303 |
| 25 | 294 | 312 | 264 | 303 |
| 26 | 294 | 312 | 261 | 300 |
| 27 | 294 | 312 | 258 | 297 |
| 28 | 288 | 306 | 252 | 297 |
| 29 | 285 | 303 | 252 | 294 |
| 30 | 285 | 300 | 246 | 294 |
| 31 | 282 | 300 | 240 | 294 |
| 32 | 279 | 300 | 234 | 294 |
| 33 | 279 | 300 | 234 | 291 |
| 34 | 279 | 300 | 234 | 285 |
| 35 | 276 | 297 | 231 | 285 |
| 36 | 276 | 297 | 228 | 285 |
| 37 | 276 | 294 | 228 | 285 |
| 38 | 273 | 294 | 228 | 282 |
| 39 | 273 | 294 | 225 | 282 |
| 40 | 272 | 294 | 225 | 282 |
| 41 | 270 | 294 | — | 279 |
| 42 | 270 | 291 | — | 279 |
| 43 | 270 | 291 | — | 276 |
| 44 | 267 | 291 | — | 276 |
| 45 | 267 | 288 | — | 276 |
| 46 | 264 | 276 | — | 276 |
| 47 | 264 | 276 | — | 276 |
| 48 | 264 | 276 | — | 273 |
| 49 | 264 | 273 | — | 273 |
| 50 | 261 | 270 | — | 273 |
| 51 | 258 | 270 | — | 273 |
| 52 | 258 | 270 | — | 273 |
| 53 | 258 | 270 | — | 273 |
| 54 | 258 | 267 | — | 270 |
| 55 | 256 | 264 | — | 270 |
| 56 | 255 | 261 | — | 267 |
| 57 | 252 | 261 | — | 264 |
| 58 | 252 | 258 | — | 261 |
| 59 | 252 | 258 | — | 261 |
| 60 | 249 | 258 | — | 258 |
| 61 | 249 | 258 | — | 258 |
| 62 | 246 | 255 | — | 252 |
| 63 | 246 | 255 | — | 252 |
| 64 | 243 | 255 | — | 252 |
| 65 | 243 | 252 | — | 252 |
| 66 | 240 | 252 | — | 252 |
| 67 | 240 | 252 | — | 252 |
| 68 | 240 | 249 | — | 252 |
| 69 | 240 | 249 | — | 249 |
| 70 | 234 | 249 | — | 249 |
| 71 | 234 | 249 | — | 249 |
| 72 | 234 | 249 | — | 249 |
| 73 | 228 | 246 | — | 249 |
| 74 | 228 | 246 | — | 246 |
| 75 | 228 | 246 | — | 243 |
| 76 | 225 | 243 | — | 240 |
| 77 | 225 | 243 | — | 240 |
| 78 | 225 | 240 | — | 237 |
| 79 | — | 240 | — | 237 |
| 80 | — | 237 | — | 234 |
| 81 | — | 234 | — | 234 |

TABLE 14-continued

| | | | | |
|---|---|---|---|---|
| 82 | — | 234 | — | 231 |
| 83 | — | 234 | — | 231 |
| 84 | — | 228 | — | 228 |
| 85 | — | 225 | — | 225 |
| 86 | — | 225 | — | — |
| Ave. Dist. all Hits | 277 | 287 | 287 | 282 |
| Standard Dev. | 32.88 | 39.53 | 48.37 | 34.18 |
| Max. Distance Hit | 354 | 387 | 381 | 363 |
| Average of Top 3 Hits | 347 | 384 | 377 | 356 |
| Average of Top 5 Hits | 341 | 376 | 368 | 352 |
| Average of Top 10 Hits | 332 | 360 | 352 | 344 |
| Average of Top 15 Hits | 326 | 348 | 341 | 338 |
| Average of Top 20 Hits | 321 | 341 | 329 | 331 |
| Average of Top 25 Hits | 316 | 336 | 317 | 325 |
| Average of Top 30 Hits | 312 | 331 | 306 | 320 |
| Average of Top 40 Hits | 303 | 322 | 287 | 312 |

The results of the player test were very positive. Both versions of the multi-layer softball 10 unexpectedly performed better than the comparable control softball, and the new multi-layer softballs 10 have a compression of over 100 lbs. lower than the conventional control softball, which has no core/mantle layers. Both of the new multi-layer softballs 10 were longer off the bat, as shown in TABLE 14. Player perception was also positive, with most players stating that the sound off the bat was equal to that of the control ball, and most players felt that the multi-layer softballs were livelier than the control balls off the bat. The multi-layer softball 10 allows for a significantly lower overall compression while maintaining or even improving the performance of the ball 10.

A pilot run of multi-layer softballs 10 was completed for further testing. The balls 10 were tested to determine physical properties. Results of the test are shown in TABLES 15 and 16 below.

TABLE 15

Statics for 0.44 COR Multi-Layer Central cores

Central core
T11 —0.40 COR
Standard Mix
Ratio
Purple Central
cores
Mold Size —88.5 mm
Sanded Weight Range 115–120 g

| | | | Central core Data | | | | |
|---|---|---|---|---|---|---|---|
| Core No. | Size Pole (in) | Weight (g) | Comp. Pole (lbf) | Comp. Eq. (lbf) | COR | 30 Blow Durability | 185 Blow Durability |
| 1 | 3.42 | 118.2 | 385.2 | 375.6 | 0.428 | — | — |
| 2 | 3.42 | 115.8 | 367.3 | 375.9 | 0.432 | — | — |
| 3 | 3.41 | 115.7 | 383.2 | 387.7 | — | Good - No Significant Denting | Look Good |
| 4 | 3.41 | 114.8 | 376.0 | 381.2 | — | Good - No Significant Denting | Look Good |
| 5 | 3.41 | 115.8 | 389.7 | 384.9 | — | — | — |
| 6 | 3.41 | 117.3 | 388.1 | 397.6 | — | — | — |
| 7 | 3.42 | 116.0 | 386.0 | 389.4 | — | — | — |
| 8 | 3.41 | 115.2 | 380.6 | 385.6 | — | — | — |
| 9 | 3.42 | 117.1 | 393.0 | 408.7 | — | — | — |
| 10 | 3.41 | 117.0 | 393.3 | 395.2 | — | — | — |
| 11 | 3.41 | 115.1 | 386.1 | 383.4 | — | — | — |
| 12 | 3.41 | 114.8 | 375.9 | 385.0 | — | — | — |
| Ave. | 3.41 | 116.1 | 385.6 | | 0.430 | Good | Good |
| Min. | 3.41 | 114.8 | 367.3 | | 0.428 | | |
| Max. | 3.42 | 118.2 | 408.7 | | 0.432 | | |

| | | Central core Data - Over Time | | | | | | | | |
|---|---|---|---|---|---|---|---|---|---|---|
| | | Original Data | | | Tested after 1 week | | | 3 weeks | | |
| Core No. | Weight (g) | Comp. Pole (lbf) | Comp. Eq. (lbf) | COR | Comp. Pole (lbf) | Comp. Eq. (lbf) | COR | Comp. Pole (lbf) | Comp. Eq. (lbf) | COR |
| 1 | 118.2 | 385.2 | 375.6 | 0.428 | 422.8 | 419.5 | 0.432 | | | |
| 2 | 115.8 | 367.3 | 375.9 | 0.432 | 398.7 | 393.1 | 0.434 | | | |

TABLE 15-continued

| Statics for 0.44 COR Multi-Layer Central cores | | | | | | | | | | |
|---|---|---|---|---|---|---|---|---|---|---|
| 5 | 115.8 | 389.7 | 384.9 | — | 417.9 | 411.9 | 0.429 | | | |
| 6 | 117.3 | 388.1 | 397.6 | — | 420.1 | 426.0 | 0.431 | | | |
| 7 | 116.0 | 386.0 | 389.4 | — | 407.6 | 418.1 | — | 388.6 | 389 | 0.425 |
| 8 | 115.2 | 380.6 | 385.6 | — | 417.9 | 408.1 | — | 394.6 | 379.8 | 0.425 |
| 9 | 117.1 | 393.0 | 408.7 | — | 416.5 | 427.1 | — | 393 | 400.8 | — |
| 10 | 117.0 | 393.3 | 395.2 | — | 424.9 | 422.7 | — | 394.5 | 396.1 | — |
| 11 | 115.1 | 386.1 | 383.4 | — | 413.5 | 415.6 | — | 390.1 | 385.9 | — |
| 12 | 114.8 | 375.9 | 385.0 | — | 402.3 | 413.2 | — | 371.4 | 381.8 | — |
| Ave. | 116.2 | 386.3 | | 0.430 | 414.9 | | 0.432 | 388.8 | | 0.425 |

TABLE 16

Statics for 0.44 COR Multi-Layer Finished Balls

Mantle Layer

Yearflow's Modified D-12 Softie
System
Mold Size 94.2 mm
Outer Layer Thickness 0.125–0.135"
Finished Ball Dudley Thunder Advance MLT 12
44
White ZN Composite
Cover
0.44 COR
Version

| Finished Ball Data | | | | | | | |
|---|---|---|---|---|---|---|---|
| Ball No. | Size Pole (in) | Weight (g) | Comp. Pole (lbf) | Comp. Eq. (lbf) | COR | 30 Blow Durability | 185 Blow Durability |
| 1 | 11 15/16" | 181.4 | 190.6 | 171.2 | 0.422 | — | — |
| 2 | 12" | 185.3 | 213.0 | 207.2 | 0.431 | — | — |
| 3 | 12" | 184.3 | 225.7 | 224.6 | 0.431 | — | — |
| 4 | 12" | 184.4 | 231.0 | 212.6 | 0.428 | — | — |
| 5 | 12" | 181.8 | 198.1 | 185.5 | — | — | — |
| 6 | 12" | 180.5 | 178.8 | 181.3 | — | — | — |
| 7 | — | 180.1 | 204.0 | 196.7 | — | — | — |
| 8 | — | 182.4 | 230.2 | 207.7 | — | — | — |
| 9 | — | 182.3 | 188.5 | 196.1 | — | — | — |
| 10 | — | 183.4 | 203.4 | 198.8 | — | — | — |
| 11 | — | 184.1 | 191.7 | 224.5 | — | Good - No Significant Denting | Good |
| 12 | — | 182.0 | 197.1 | 210.9 | — | Good - No Significant Denting | Good |
| Ave. | 12" | 182.7 | 202.9 | | 0.428 | Good | Good |
| Min. | 11 15/16" | 180.1 | 171.2 | | 0.422 | | |
| Max. | 12" | 185.3 | 231.0 | | 0.431 | | |

| Finished Ball Data - Over Time | | | | | | | | | | |
|---|---|---|---|---|---|---|---|---|---|---|
| | | Original Data | | | After 1 week | | | After 2 weeks | | |
| Ball No. | Weight (g) | Comp. Pole (lbf) | Comp. Eq. (lbf) | COR | Comp. Pole (lbf) | Comp. Eq. (lbf) | COR | Comp. Pole (lbf) | Comp. Eq. (lbf) | COR |
| 1 | 181.4 | 190.6 | 171.2 | 0.422 | 172.9 | 160.9 | 0.414 | | | |
| 2 | 185.3 | 213.0 | 207.2 | 0.431 | 200.4 | 187.0 | 0.432 | | | |
| 5 | 181.8 | 198.1 | 185.5 | — | 197.3 | 191.6 | 0.428 | 201.8 | 191.2 | — |
| 6 | 180.5 | 178.8 | 181.3 | — | 175.3 | 183.3 | 0.429 | 176.1 | 184.4 | — |
| 7 | 180.1 | 204.0 | 196.7 | — | 199.0 | 197.8 | — | 218.1 | 208.6 | 0.426 |
| 8 | 182.4 | 230.2 | 207.7 | — | 229.8 | 210.3 | — | 252.5 | 225.9 | 0.430 |
| 9 | 182.3 | 188.5 | 196.1 | — | 189.3 | 195.8 | — | | | |
| 10 | 183.4 | 203.4 | 198.8 | — | 201.3 | 193.8 | — | | | |

TABLE 16-continued

| Statics for 0.44 COR Multi-Layer Finished Balls | | | | | | | | | | |
|---|---|---|---|---|---|---|---|---|---|---|
| 11 | 184.1 | 191.7 | 224.5 | — | 195.8 | 223.5 | — | 208.9 | 257.8 | — |
| 12 | 182.0 | 197.1 | 210.9 | — | 200.5 | 213.2 | — | 213.2 | 231.5 | — |
| Ave. | 182.3 | 198.8 | | 0.427 | 195.9 | | 0.426 | 214.2 | | 0.428 |

The foregoing description is, at present, considered to be the preferred embodiments of the MULTI-LAYER SOFTBALL. However, it is contemplated that various changes and modifications apparent to those skilled in the art may be made without departing from the present invention. Therefore, the foregoing description is intended to cover all such changes and modifications encompassed within the spirit and scope of the present invention, including all equivalent aspects.

What is claimed is:

1. A softball comprising:

a composite core comprising (1) a central core having a first hardness, and (2) a first outer core layer adjacent the central core, the first outer core layer having a second hardness less than the first hardness; and a cover surrounding the composite core, the softball having a compression of about 400 lbs. or less and a coefficient of restitution of from about 0.400 to about 0.500 at 88 feet/second.

2. The softball according to claim 1, wherein the central core comprises a first urethane composition.

3. The softball according to claim 1, wherein the first outer core comprises a second urethane composition.

4. The softball according to claim 1, wherein the composite core further comprises a second outer core layer adjacent the first outer core layer, the second outer core having a third hardness.

5. The softball according to claim 4, wherein the third hardness is greater than the second hardness.

6. The softball according to claim 4, wherein the third hardness is less than the second hardness.

7. The softball according to claim 1, wherein the softball has a compression of about 375 lbs. or less.

8. The softball according to claim 1, wherein the softball has a compression of about 325 lbs. or less.

9. The softball according to claim 1, wherein the softball has a compression of about 200 lbs. or less.

10. The softball according to claim 1, wherein the central core comprises a first urethane composition, and the first outer core layer comprises a second urethane composition.

11. The softball according to claim 10, further comprising a second outer core layer adjacent the first outer core layer, the second outer core layer comprising a third urethane composition and having a third hardness.

12. The softball according to claim 11, wherein the third hardness is greater than the second hardness.

13. The softball according to claim 11, wherein the third hardness is less than the second hardness.

* * * * *